United States Patent [19]

Sasaki et al.

[11] Patent Number: 4,653,742

[45] Date of Patent: Mar. 31, 1987

[54] SHEETS SEPARATING AND FEEDING APPARATUS

[75] Inventors: Naoya Sasaki, Shimoinayoshi; Masataka Kawauchi; Yoshio Fukudome, both of Ishioka; Fumio Takeda, Shimoinayoshi; Yoichi Suzuki, Kashiwa; Toshio Mirubayashi, Toyoake; Itsunori Utsumi, Owariasahi, all of Japan

[73] Assignee: Hitachi, Ltd., Tokyo, Japan

[21] Appl. No.: 750,782

[22] Filed: Jul. 1, 1985

[30] Foreign Application Priority Data

Jun. 29, 1984 [JP] Japan ..... 59-133133
Jun. 29, 1984 [JP] Japan ..... 59-133134

[51] Int. Cl.[4] ..... B65H 3/06

[52] U.S. Cl. ..... 271/114; 271/119; 271/122; 271/146; 271/166

[58] Field of Search ..... 271/114, 119, 120, 122, 271/125, 134, 135, 37, 146, 166

[56] References Cited

U.S. PATENT DOCUMENTS

| | | | |
|---|---|---|---|
| 1,291,074 | 1/1919 | Milmoe | 271/146 X |
| 2,764,409 | 9/1956 | La Bombard | 271/146 X |
| 3,334,890 | 8/1967 | La Bombard | 271/146 X |
| 3,578,314 | 5/1971 | Ward | 271/166 X |
| 3,976,291 | 8/1976 | Bernardi | 271/146 X |
| 4,021,032 | 5/1977 | Gross | 271/166 |
| 4,034,975 | 7/1977 | Agnew | 271/166 X |
| 4,437,658 | 3/1984 | Olson | 271/146 X |
| 4,494,745 | 1/1985 | Ward | 271/166 X |

*Primary Examiner*—Richard A. Schacher
*Attorney, Agent, or Firm*—Antonelli, Terry & Wands

[57] ABSTRACT

This invention relates to a apparatus for separating and feeding sheets such as sheets of paper comprising an accommodation box for accommodating the sheets of paper stacked by their own weight, a pick-up roller provided so that the upper surface thereof projects into the interior of the box to bear the weight of the stacked sheets of paper, a separation arrangement comprising a frictional roller and the feed roller and provided so as to face an ejection port of the accommodation box from which sheets are sent out to the separation arrangement, and a support arrangement disposed on the side opposite to the ejection port supports the end, opposite to the ejection port, of the sheets of paper, and for allowing the lowermost sheet end to be free of the weight of the sheet thereabove when the lowermost sheet is moved to the ejection port side so that frictional resistance of the lowermost sheet is reduced greatly and the pick-up roller can surely pick up and convey the sheet one by one from the lower side of the sheets. The support arrangement comprises a roller freely rotating or a roller driven by a driving device, the latter have a circular or elliptical cross-sectional shape. The elliptical roller vibrate the end portion of the sheets opposite to the ejection port to make gaps therebetween.

28 Claims, 24 Drawing Figures

SHEETS SEPARATING AND FEEDING APPARATUS

BACKGROUND OF THE INVENTION

The present invention relates to a sheet separating and feeding apparatus adapted to separate and individually feed sheets, stacked in a large number in accommodation means by their own weight, sequentially from the bottom of the accommodation means, and, more particularly, to an apparatus for separating and sequentially individually feeding bank notes, stacked in a large number in an accommodation box, the bottom of the accommodation box.

An apparatus for separating and feeding sheets of paper such as bank notes stacked in a large number in an accommodation box is disclosed in, for example, Japanese Patent Laid-Open No. 57-8890, wherein the bank notes are stacked in the accommodation box while being inclined in a downward feeding direction, and an eccentric roller effects the feeding, and an eccentric roller contacts with the center of the lowermost surface of the accommodated bank notes with respect to the feeding direction, a feeding roller positioned on the lower part side of the inclined bank notes, and a friction roller in contact with the feeding roller. Rotation of the eccentric roller loosens a stack of the accommodated bank notes, while the feeding roller and the friction roller constitute together a separation section to separate and feed the bank notes. The apparatus thus arranged can easily separate bank notes, particularly new bank notes which have large resistance therebetween, but gradually loses its ability to separate bank notes as the degree of wear increases, so that notes which have long been in circulation may not be separated. Additionally, because bank notes are accommodated in an inclined state, the efficiency of accommodating bank notes is low and this requires a larger apparatus.

Furthermore, when a pile of bank notes are stacked to effectively utilize a space for accommodating bank notes, it is difficult to separate and feed the bank notes one by one simply by rotating the eccentric roller. This tendency becomes significant particularly when many bank notes are stacked in a single stack.

SUMMARY OF THE INVENTION

The present invention has been accomplished in view of the above, and has for its object to provide a sheets separating and feeding apparatus which reliably separates and feeds sheets, stacked in a large number in accommodation means by their own weight, sequentially from the bottom one by one.

Another object of the present invention is to provide a sheets separating and feeding apparatus which reliably separates and feeds many sheets in a single stack, sequentially from the bottom one by one, and which accommodates said stack in a highly efficient manner.

The sheets separating and feeding apparatus of the present invention which is adapted to separate and feed sheets, stacked in a large number in accommodation means by their own weight, sequentially from the bottom one by one, includes in the lower part of the accommodation means pick-up means disposed to bear the weight of the stacked sheets of paper and to pick and move the sheets of paper toward an ejection port provided with the accommodation means, and support means for supporting the stacked sheets in the vicinity of their ends opposite to the ejection port, the support means having a support point gradually shifted downwards according to the movement of the support sheet toward the ejection port, and allowing the sheet of paper being conveyed at its end opposite to the ejection port to be free of the weight of the remaining sheets thereabove. The end opposite to the ejection port of the lowermost of the sheets supported on the support means disengages from the support means and is displaced downward, as that sheet is moved toward the ejection port. This forms gaps between superimposed sheets and reduces friction resistance between those sheets due to the weight of the remaining sheets thereabove, so that the lowermost one of a stack of the accommodated sheets can be always surely forwarded or conveyed to the separation section by the pick up means and then separated and fed sequentially one by one.

According to an aspect of the present invention, the support means is designed to forcedly disengage the end of the lowermost sheet opposite the ejection port among the supported sheets from the support means and to bend that end downward. This consecutively forms a gap between successive sheets and greatly reduces friction between those sheets due to the weight of the remaining sheets thereabove, whereby the pick-up means can always reliably pick up and move the lowermost of the accommodated sheets to the separation section and then separate and feed the same sequentially one by one.

According to another aspect of the present invention, the support means includes means for vibrating the ends of sheets opposite to the ejection port, whereby the sheet ends are separated from each other to provide gaps therebetween and to reduce greatly friction between the sheets.

According to further another aspect to the present invention, the support means is of rollers which are freely rotated by the movement of the supported sheets toward the ejection port.

BRIEF DESCRIPTION OF THE DRAWINGS

FIGS. 7*b* and 7*c* are time charts for explaining the operation of the apparatus shown in FIG. 5;

DETAILED DESCRIPTION

Figure 1:
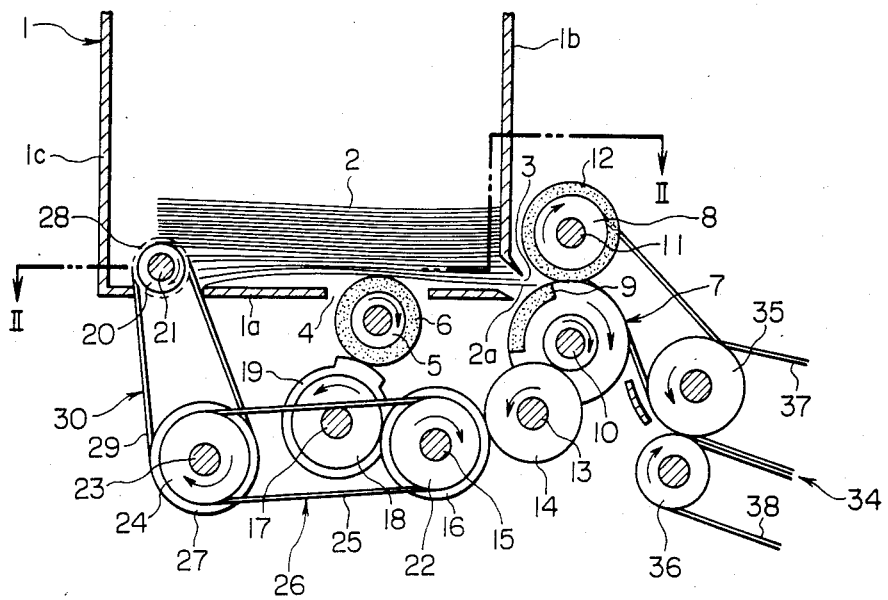
FIG. 1 is a sectional side view of an embodiment of a sheets separating and feeding apparatus according to the present invention.

Referring now to the drawings wherein like reference numerals are used throughout the various views to designate like parts and, more particularly, to FIGS. 1–3 and 4*a*–4*d*, a sheet separating and feeding apparatus according to the present invention includes accommodation box generally designated by the reference numeral to accommodate sheets such as sheets of paper 2, a bill or the like sequentially stacked from above by their own weight. The accommodation box 1 includes a bottom guide plate 1*a*, a guide plate 1*b* on an ejection port side, a guide plate 1*c* on the side opposite to an ejection port, and side guide plates 1*d*, with a gap 3 being formed at the joint portion between the bottom guide plate 1*a* and the ejection port side guide panel 1*b* of the accommodation box 1. The sheets of paper 2 are sequentially moved or conveyed through the gap 3 to separation means by pick-up means to be described more fully below. An elongated hole 4 extending (in the widthwise direction of paper sheets) perpendicular to the direction of feeding of paper sheets is formed in the bottom guide plate 1*a* of the accommodation box 1 at a position slightly toward the ejection port from the center. Pick-up means such as, for example, a pick-up roller 5 is disposed in the elongated hole 4 for picking up the sheets of paper 2. The pick up rollers 5 picks up and conveys the lowermost 2*a* of the sheets of paper 2 accommodated in the accommodation box 1 to the gap 3 at the ejection port, and provided over all its circumference of full width with a friction member 6 made of a material such as rubber. The pick-up roller 5 faces the interior of the accommodation box 1 through the elongated hole 4 in the bottom guide plate 1*a*, and abuts with the lowermost surface of the sheets of paper 2 so as to bear the weight of the accommodated sheets of paper 2.

A plurality of feed rollers generally designated by the reference numeral 7 and plurality of friction rollers 8, forming separation means for sheets of paper, are disposed opposite each other with the gap 3 of the accommodation box 1 therebetween. The plurality of feed rollers 7 are fixed to a shaft 10 arranged in the widthwise central portion of the sheets of paper 2 in the vicinity of the gap 3. Each feed roller 7 has a recessed groove 7*a* over an entire circumference thereof, and larger diameter portions 7*b* on both side of the recessed groove 7*a* each have a friction member 9 made of a material such as rubber bonded onto a part of the circumference over a required length.

The plurality of feed rollers 7 are drive in a direction to feed of the sheets of paper 2 as indicated at an arrow by a driving source such as, for example, an electric motor (not shown) coupled to the shaft 10. The plurality of friction rollers 8 are fixed to a shaft 11 so that each friction roller is arranged so as to confront the recessed groove 7*a* of the feed roller 7. Each friction roller 8 is provided over all its circumference of full width a friction member 12 made of a material such as rubber and having a high coefficient of friction. The plurality of friction rollers 8 are driven in the direction to return the sheets of paper as indicated by an arrow by a driving source (not shown) such as an electric motor coupled to the shaft 11.

Alternatively, each of the friction rollers 8 may be entirely formed of a member having a high coefficient of friction. Furthermore, in place of the driving structure, the friction roller 8 may be formed of a friction member providing a friction force greater than a certain level with the sheets of paper, for example, so long as it has capability of feeding only the lowermost one to the ejection port among the sheets paper conveyed through the ejection port 3.

Rotation of the shaft 10 for the feeding rollers 7 is intermittently transmitted to the pick-up roller 5 via a roller 14 supported by a shaft 13, a roller 16 supported by a shaft 15, an intermediate rubber roller 18 and a cam roller 19 both supported by a shaft 17.

With this arrangement, the pick-up roller 5 is intermittently rotated little by little with rotation of the feed roller 7 to convey the sheets of paper in contact therewith to the separation means side.

Figure 2:
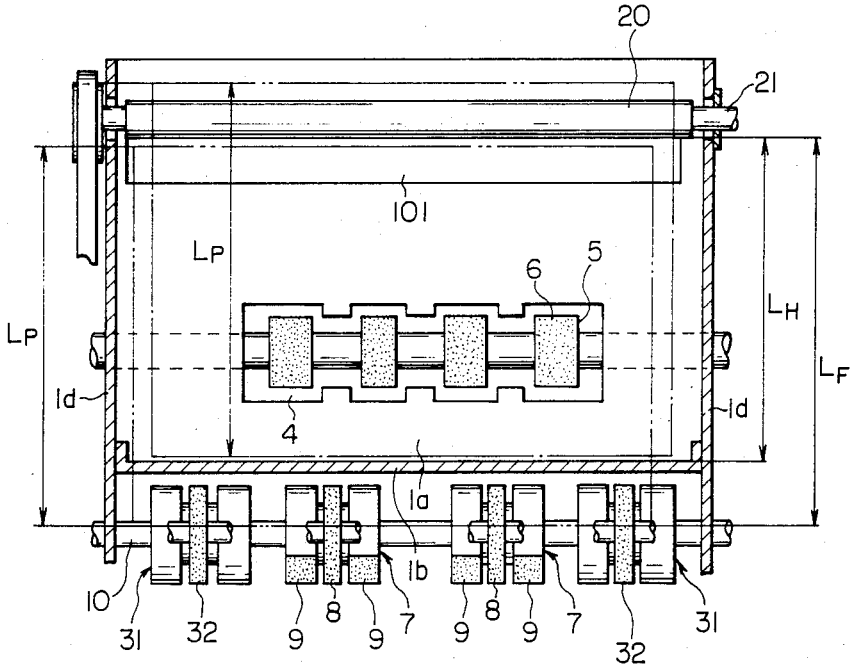
FIG. 2 is a sectional view of the sheets separating and feeding apparatus shown in FIG. 1.

In the vicinity of the bottom guide plate within the accommodation box 1 at the end opposite to the ejection port, there is disposed a circular driving roller 20, for example, as means for supporting sheets of paper and imparting conveying force to the sheets. The driving roller 20 engages the end of the lowermost sheet opposite the ejection port among the many sheets of paper stacked in the accommodation box 1, thereby distributing the weight of the sheets of paper, and when driven rotatively, the driving roller sends out a few of the borne paper sheets to the ejection port so that it disengages from the ends of those paper sheets opposite to the ejection port. Therefore, the driving roller 20 is formed of a rod type roller with a circular section, and its peripheral surface in contact with the sheets of paper 2 is made of a material having a low coefficient of friction with paper sheets, a material such as plastic. The mounting position of the driving roller 20 is determined as shown in FIG. 2. Assuming that the sheets of paper 2 have a length $L_P$ in the direction of feeding, the distance from a position slightly offset, e.g., several millimeters, toward the side opposite to the ejection port from where the sheet is grasped by the feed roller 7 and the friction roller 8 (i.e., acting portion of the separation means) to the end of the driving roller 20 on the ejection port side is equal to $L_F$, and the distance between the ejection port guide plate 1*b* of the accommodation box 1 and the end of the driving roller 20 on the ejection port side is equal to $L_H$, the driving roller 20 is disposed to meet the relationships of $L_F > L_P$ and $L_H < L_P$.

Furthermore, the driving roller 20 is disposed such that its upper end is always above the bottom guide plate 1*a* of the accommodation box 1.

With this arrangement, a plurality of paper sheets 2 stacked in the accommodation box 1 are disposed on the driving roller 20 at the ends of those paper sheets opposite to the ejection port in such a state that the large number of paper sheets are guided between the guide plate 1*b* on the ejection port side and the guide plate 1*c* on the side opposite to the ejection port. Then, as several sheets of paper in the accommodation box 1, including the lowermost sheet and conveyed by the pick up roller 5 to the ejection port, come into such a state that their ends on the ejection port side are several millimeters from a position on front of position where they are grasped by the separation means, their ends opposite to the feed-out side are disengaged from the driving roller 20. The driving roller 20 is fixed to a shaft 21 and rotated clockwise as indicated at an arrow upon rotation of the shaft 21. Torque of the shaft 10 for the feed rollers 7 is transmitted to the shaft via port transmission means 26 comprising a pulley 22 fixed to the shaft 15, a pulley 24 fixed to a shaft 23 and a belt 25 stretched around these pulleys 22, 24, and another power transmission means 30 comprising a pulley 27 fixed to the shaft 23, a pulley 28 fixed to a shaft 27 and a belt 29 stretched around these pulleys 27, 28. Incidentially, the power transmission means 26 and 30 are not limited to such a belt mechanism and may, for example, be achieved by the use of a gear mechanism or a link mechanism.

To the shaft 10 supporting the feeding rollers 7 fixed thereto, there are fixed a pair of stopper rollers 31 on both ends of the sheets of paper 2 in the widthwise direction outside a group of the plural feeding rollers. The stopper rollers 31 have each a recessed groove 31*a* over all the circumference thereof similar to the feed roller 7, and larger diameter portions 31*b* on both sides of the recessed groove 31*a* are each formed of a material having the small coefficient of friction all over the circumference thereof. A friction roller 32 is disposed opposite the recessed groove 31*a* of the stopper roller 31 such that the friction roller bites into the recessed groove 31*a*. Similarly to the friction roller 8, the friction roller 32 is provided all over its circumference of full width with a friction member 33 such as rubber having a high coefficient of friction, and fixed to the shaft 11.

The combination of each pair of stopper rollers 31 and friction rollers 32 disposed on both ends of paper sheets in the widthwise direction acts to provide a force for blocking ejection of the paper sheets, and hence constitutes skew prevention means for aligning skewed paper sheets.

Although the foregoing separation means and skew prevention means for the sheets of paper are arranged into the roller structure, they may have a belt structure. The sheet of paper 2 separated and fed by the separation means is forwarded into a subsequent feeding path 34 for further transportion. The feeding path 34 is composed of, for example, rollers 35, 36 and belts 37, 38.

The separating and feeding operation of one embodiment of the apparatus according to the present invention shown in FIGS. 1 to 3 will be described below with reference to FIG. 4.

Figure 4A:
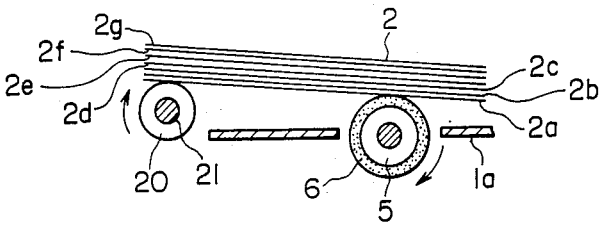
FIGS. 4*a* to 4*d* are sectional views for explaining the separation of pick-up rollers and a support means.
Figure 4B:
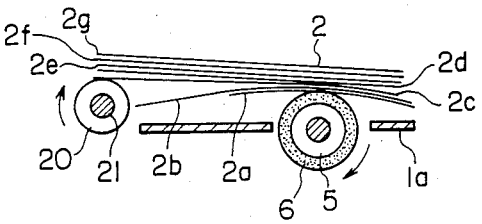
Figure 4C:
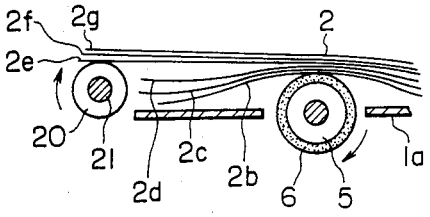
Figure 4D:
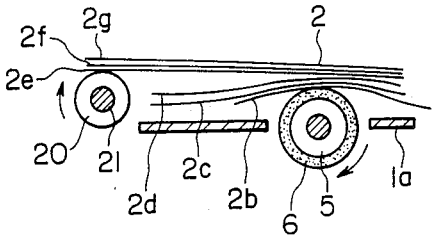

FIG. 4*a* shows a state that in which the sheets of paper 2 are stacked in the accommodation box 1. At this time, the sheets of paper 2 are stacked and supported on the pick-up roller 5 and the driving roller 20. When separating and feeding the sheets of paper 2 from that state, the driving source, as an electric motor, is operated to drive both the pick-up roller 5 and the driving roller 20 clockwise. Upon this, as shown in FIG. 4*b*, both a drawing or pick up force exerted by the pick-up roller 5 intermittently rotated with constant pitch and a conveying force exerted by the driving roller 20 cause, in combination, the lowermost sheet of paper 2*a* (i.e., the paper sheet in contact with the pick-up roller 5) to be disengaged at this end opposite to the feed-out side from the driving roller 20 and, at the same time, a friction force between the super-imposed sheets of paper causes a next sheet of paper 2*b* in contact with the paper sheet 2*a*, for example, to be also disengaged at its end opposite to the feed-out side from the driving roller 20 while being frictionally dragged with the paper sheet 2*a*. Then, as shown in FIG. 4*c*, after the end of the lowermost paper sheet 2*a* at the ejection port has reached the point where it is grasped by the separation means and has been separated and fed out thereby, the pick-up roller 5 stops its rotation. Meanwhile, the driving roller 20 still continues to rotate so that a conveying force exerted by the driving roller 20 causes other several sheets of paper 2*c*, 2*d* stacked more above the paper sheet 2*b* to be further disengaged at their ends opposite to the ejection port from the roller 20. Thus, several of the stacked sheets of paper to be separated are always brought into a free state at their ends opposite to the ejection port. As shown in FIG. 4*d*, the pick-up roller 5 starts to rotate again from that state, whereby the paper sheet 2*b* in a free state at its end opposite to the ejection port is easily forwarded to the point where it is grasped by the separation means with rotation of the pick-up roller 5 and then separated and fed out by the same means. Thereafter, the above procedures are successively repeated so that the large number of paper sheets stacked in the accommodation means are reliably separated and fed out from the bottom one by one. In this connection, by moving the sheets of paper about several millimeters toward the ejection port, the ends of those paper sheets on the ejection port can reach the point at which they are grasped by the separation means. Therefore, it is enough for the coefficient of friction of the pick-up roller 5 with the sheet of paper to provide a conveying force that permits the sheet of paper to move through several millimeters, and hence the pick-up roller 5 can, for example, be formed of plastic.

Although, in the embodiment mentioned above, the operation was described in connection with the driving roller using a round roller as the support means, the roller may have an elliptical cross-section other than the circular section.

Another embodiment of the present invention where the support means is formed of a driving roller 39 with an elliptical cross-section will be described below with reference to FIGS. 5, 6*a* to 6*f*, and 7*a* to 7*c*.

Figure 3:
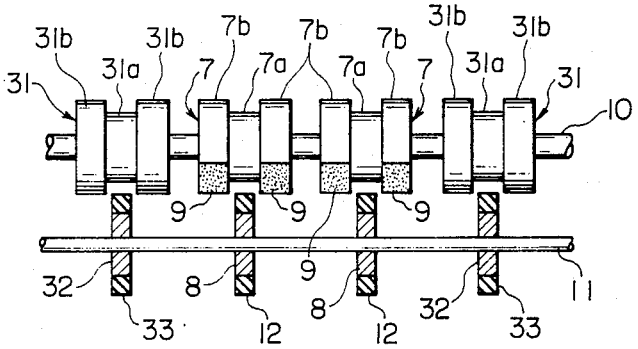
FIG. 3 is a partially sectional view of a separating means of the apparatus shown in FIGS. 1 and 2.
Figure 5:
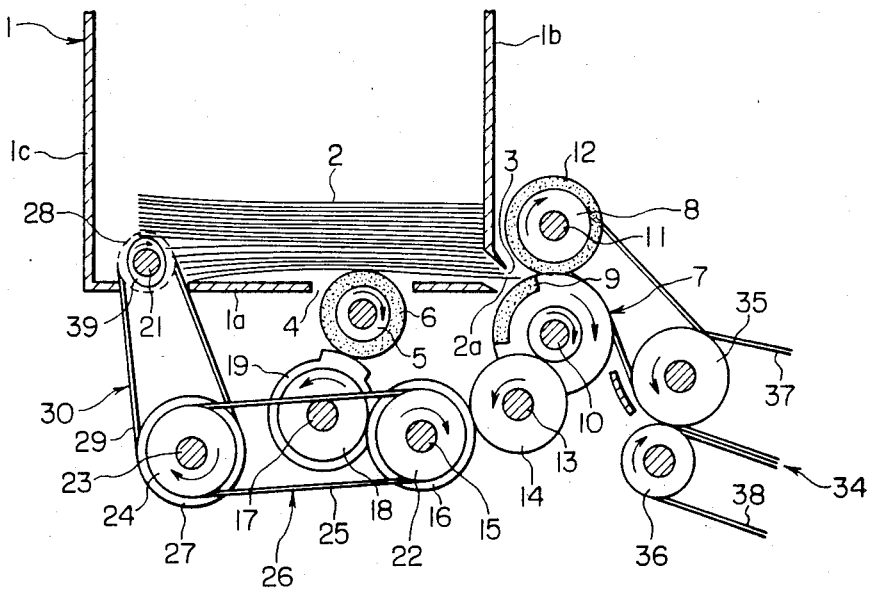
FIG. 5 is a sectional side view of another embodiment of an apparatus for separating and feeding sheets according to the present invention.

This embodiment is the same as one shown in FIGS. 1 to 3 except that the driving roller 39 with an elliptical cross-section is used for the driving roller 20 of the apparatus shown in FIGS. 1 to 3. Namely, in FIG. 5 showing an apparatus for separating and feeding sheets of paper, a pick-up roller 5, a feeding roller 7, friction roller 8, a roller 21 fixing the elliptical driving roller 39, power transmission means 26 and 30 for transmitting driving force to the roller 21, and feeding path 34 are the same as the corresponding ones of the apparatus shown in FIGS. 1 to 3. Therefore, the driving roller 39, and the operation of the apparatus will be described.

FIGS. 6*a* to 6*f* are shown to explain the separating and feeding operation in this embodiment, in which a point A designates a cross point where the long diameter axis off the driving roller 39 intersects its circumference.

Figure 6A:
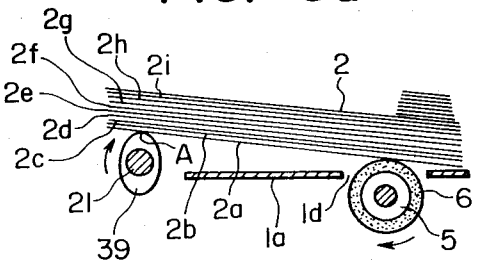
FIGS. 6*a* to 6*f* are partial sectional views of the apparatus of FIG. 5 for explaining the operation of a support means.
Figure 6B:
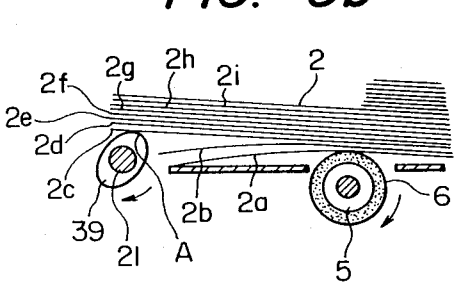
Figure 6C:
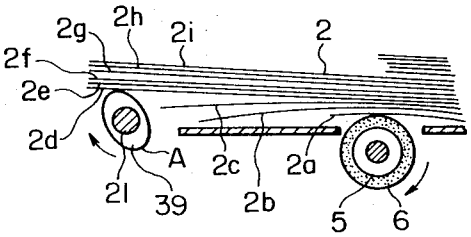

FIG. 6*a* shows a state that the sheets of paper 2 are accommodated in the accommodation box 1. At this time, the roller 39 is in such a state that its long diameter extends perpendicularly to the direction of feed and the sheets of paper 2 are supported at their ends opposite to the ejection port on the roller surface in the direction of this long axis. In this state, the driving roller 39 and the pick up roller 5 are both further rotated to start the operation for forwarding the lowermost one 2*a* of the sheets of paper into the nip of the separation means. Upon this operation, as shown in FIG. 6*b*, the lowermost sheet of paper 2*a* and several sheets of paper stacked thereabove, e.g., the paper sheet 2*b*, are cuased at their ends opposite to the ejection port to be scraped away and disengaged from the driving roller 39 by virtue of friction forces between the superimposed paper sheets and a conveying force of the driving roller 39. With the sheets of paper 2 disengaged at their ends opposite to the ejection port from the driving roller 39, the paper sheets 2*a*, 2*b* are dropped downward and cause a gap between the superimposed paper sheets at their ends opposite to the ejection port, thus resulting in a free state. As a result, when forwarded into the gap of the separation means, the paper sheet 2*a* is released at its end opposite to the ejection port from the resistance between the superimposed paper sheets due to the weight of a stack of paper sheets, so that the paper sheet 2*a* is reliably conveyed into the separation means and then separated and fed out by the same means, as shown in FIG. 6*c*.

Figure 6D:
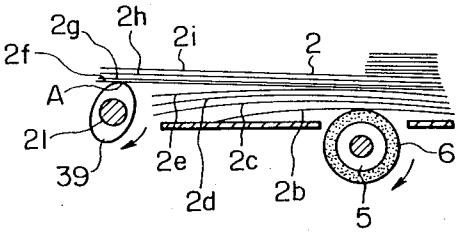
Figure 6E:
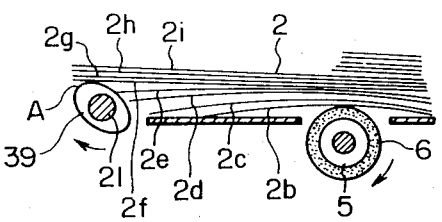
Figure 6F:
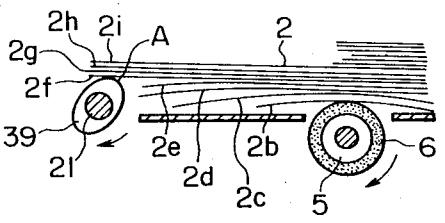

Even after completion of one rotation of the pick up roller 5, as shown in FIGS. 6*d* and 6*e*, the driving roller 39 is continuously rotated to disengage several sheets of paper, e.g., paper sheets 2*c*, 2*d*, 2*e*, at their ends opposite to the ejection port from the driving roller 39 in a similar manner as mentioned above. Thus, when the pick up roller 5 conveys the paper sheet 2*b* to the point where it is grasped by the separation means as shown in FIG. 6*f*, the paper sheets 2*c*, 2*d*, 2*e* are likewise brought into a free state at their ends opposite to the ejection port and the paper sheet 2*b* is reliably conveyed to the point where it is grapsed between the separation means, then separated and fed out by the same means.

In the foregoing embodiment, the driving roller 39 is formed to have an elliptical cross-section. This causes the stack of paper sheets to be jarred as the driving roller 39 rotates while contacting with the paper sheets, thereby reducing frictional resistance between the superimposed paper sheets. In other words, the driving roller 39 in the foregoing embodiment is designed to support, send out as well as shake the sheets of paper. Although the number of revolutions of the driving roller can be set arbitrarily, it is desirably set to be an integer multiple of that of the feed roller 7.

Figure 7A:
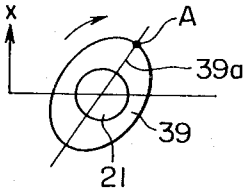
FIG. 7*a* is a diagram for explaining a relationship between a vertical position of a point A of a roller and time.
Figure 7B:
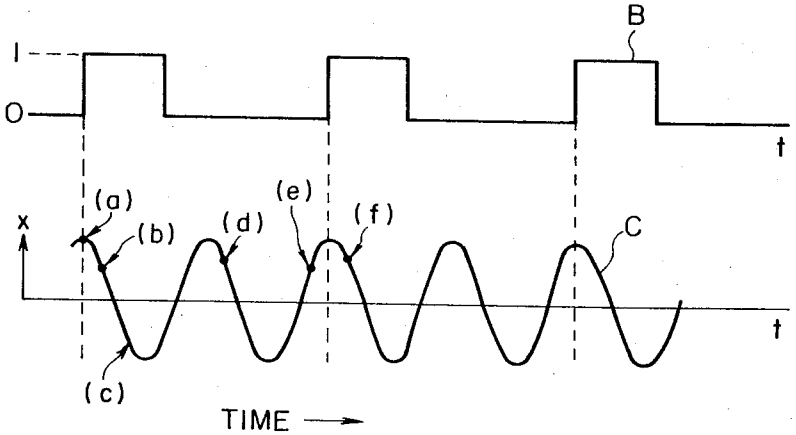
Figure 11:
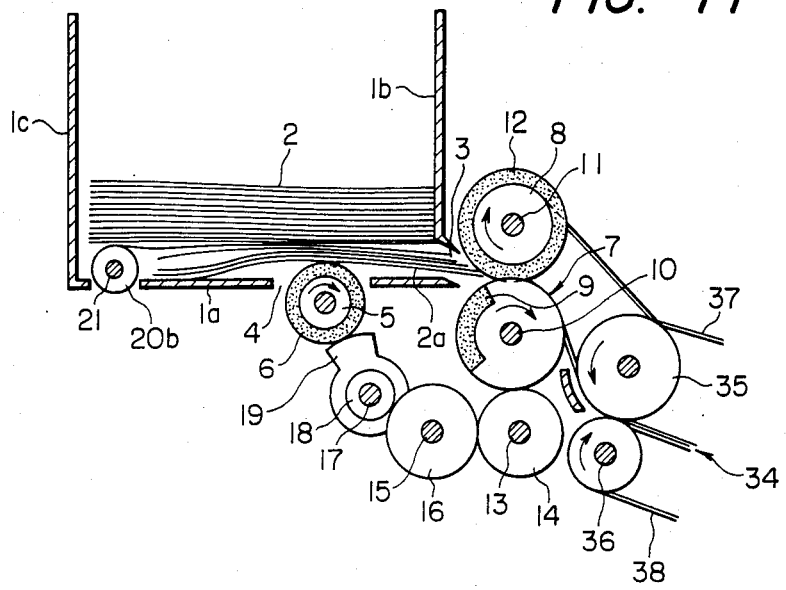
FIG. 11 is a sectional side view of an apparatus for separating and feeding sheets according to another embodiment of the present invention.

FIG. 7 is a time chart showing rotational states of the driving roller in operation of the embodiment as shown in FIGS. 5 and 6. FIG. 7*a* illustrates a schematic sectional view of the elliptic driving roller 39 fixed to the rotating shaft 21, in which the point A designates an intersection where a long diameter axis 39*a* of the driving roller 39 intersects its circumference, and x designates a vertical component of a locus of the point A. Further, a curve B of FIG. 7*b* gives a time chart showing rotational states of the pick up roller 5 with the axis of the abscissa representing a time t and the axis of the ordinate representing a rotational state, in which the state of "0" indicates a non-rotating state and the state of "1" indicates a rotating state. In FIG. 7*b*, a curve C gives a time chart showing a vertical component of a locus of the point A locating on the circumference of the driving roller 39 with an elliptic section as shown in FIG. 7*a*, in which the axis of the abscissa represents a vertical component x. in FIG. 7*c*, points a, b, c, d, e and f on the waveform indicating the vertical component of a locus of the point A correspond to locations of the point A in FIGS. 6*a* to 6*f*, respectively.

As seen from the figures, in the embodiment, the driving roller 39 is rotated twice during one rotational period of the pick up roller 5, that is, the time interval between a firt occurence of the rotational state of the driving roller 39 and the next occurence of the same.

Figure 8:
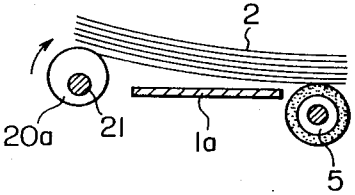
FIGS. 8, 9 and 10 each are a partial sectional view of another embodiment of an apparatus for separating and feeding sheets according to the present invention.
Figure 9:
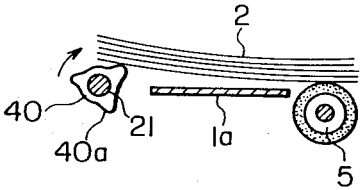
Figure 10:
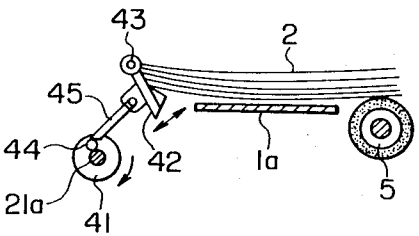

FIGS. 8, 9 and 10 show different support means in still other embodiments of the apparatus of the present invention. The other construction than the support means for supporting the sheet ends opposite to the ejection port is the same as shown in FIGS. 1 to 3.

In the embodiment shown in FIG. 8 a support roller 20*a* is fixed to the rotating shaft 21 in an eccentric relation. With this arrangement, when the rotating shaft 21 is rotated through a driving source (not shown), the driving roller 20*a* is caused to rotate while vertically fluctuating a contact point with the sheets of paper at their ends opposite to the feed-out side. This imparts vibration to the sheets of paper on the side opposite to the ejection port, thereby reducing friction resistance between the superimposed paper sheets.

In the embodiment shown in FIG. 9, a plurality of projections 40*a* are provided on the outer periphery of a driving roller 40 fixed to the rotating shaft 21. Also with this arrangement, vibrations are imparted to the sheets of paper 2 on the side opposite to the ejection port, thereby reducing friction resistance between the superimposed paper sheets.

The embodiment shown in FIG. 10 is so arranged that a rotating disc 41 is fixed to the rotating shaft 21*a* which corresponds to the rotating shaft 21*a* in FIG. 1 or 5, a support member 42 engaging the sheets of paper 2 at their ends opposite to the ejection port is supported rotatably about a fulcrum 43, and the support member 42 is coupled to the rotating disc 41 through a pin 44 and a link 45.

Also with this arrangement, when the rotating shaft 2 1*a* is driven, the support member 42 is rotated through the link 45 about the fulcrum 43 to impart vibration to the stack of paper on the side opposite to the ejection port, so that the lowermost sheet of paper can be reliably conveyed to the point where it is grasped by the separation means.

The embodiment of FIGS. 11 and 12*a*–12*d* is the same as the apparatus shown in FIGS. 1 to 3 except that the roller 20*b* is freely rotatable and the power transmission means is not used.

An accommodation box is used to accommodate sheets of paper, bills or the like and comprises a bottom guide plate 1*a*, a guide plate on the ejection port side 1*b*, a guide plate 1*c* on the side opposite to the ejection port, and side guide plates (not shown) as shown in FIG. 2. A gap 3, that is, the ejection port is formed at the joint portion between the bottom guide plate 1*a* and the ejection port side guide panel 1*b*, and the sheets of paper 2 are conveyed through the port to separation means by a pick-up roller 5. The separation means is composed of a feeding roller 7 with a partial rubber surface 9 fixed to a drive shaft 10, and a friction roller 8 which has the surface portion 12 being formed of rubber and which is fixed to a shaft 11 to rotate in a direction shown by an arrow. The pick-up roller 5 has the outer peripheral portion made of rubber 5, and is mounted on a shaft so that the upper surface porjects a little into the interior of the accommodation box through a slot 4. The lowermost sheet 2*a*, is supported by the pick-up roller 5. The pick-up roller 5 is rotated intermitantly by a pulley 18 having a cam 19 and mounted to a shaft 17. The pulley is driven by the feeding roller 7 through a pulley 14 mounted on a shaft 13 and a pulley 16 mounted on a shaft 15. The free roller 20*b* is mounted on a shaft to freely rotate and support the ends of the sheets of paper 2 opposite to the ejection port 3. The free roller 20*b* also projects slightly over the bottom guide plate through a slot formed therein. The relative distances between the feeding roller 7, the pick-up roller 5 and the free roller 20*b* are the same as the apparatus shown in FIGS. 1 to 3.

The operation of this embodiment of the apparatus for separating and feeding sheets of paper is explained hereinafter, referring to FIGS. 12*a* to 12*d*.

Figure 12A:
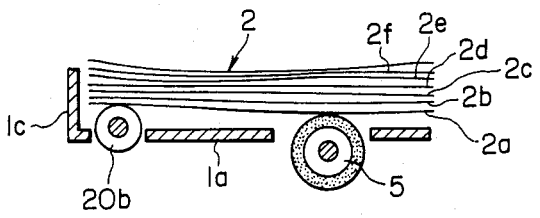
FIGS. 12*a* to 12*d* are partial sectional views of the apparatus shown in FIG. 11 for explaining the operation of a support means.

FIG. 12*a* shows a state that the sheets of paper 2 are stacked by their own weight. Under this state, the sheets of paper 2 are supported by and stacked on the pick up roller 5 and free roller 20*b*.

When the sheets of paper are separated and conveyed, first a driven source, such as a motor, is operated to drive the pick-up roller to rotate clockwise, whereby the operation that the lowermost sheet of paper 2*a* contacting with the pick-up roller 5 is fed to the separation means starts. By the operation, the end of the lowermost sheet of paper 2*a* opposite to the ejection port side is disengaged from the free roller 20*b*, additionally several sheets of paper, for example 2*b*, 2*c* above the sheet 2*a* are dragged by the frictional force caused between the sheets and the end of the sheets of paper 2*b*, 2*c* are disengaged from the free roller 20*b* in the vicinity of the end of the sheets opposite to the ejection port 3.

Figure 12B:
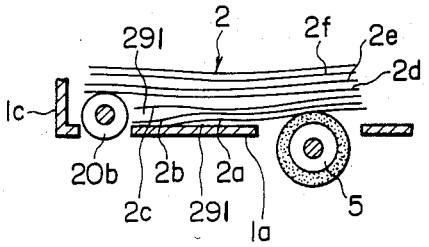
Figure 12C:
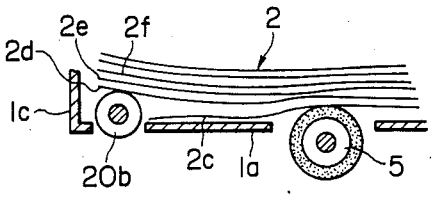

As shown in FIG. 12*b*, the ends, opposite to the ejection port 3, of the sheets of paper 2*a*, 2*b*, 2*c* drop downwards so that gaps 291 therebetween are formed and the ends are made free. Therefore, when the sheet of paper 2*b* is moved to the engaging point of the separation means, the frictional resistance caused between the sheets by the weight of the stacked sheets on the side opposite to the ejection port 3 is removed and the sheet 2*b* is surely conveyed to the engaging portion of the separation means. Further, as shown in FIG. 12*c*, the sheet 2*c* also is surely sent to the engaging portion of the separation means.

Figure 12D:
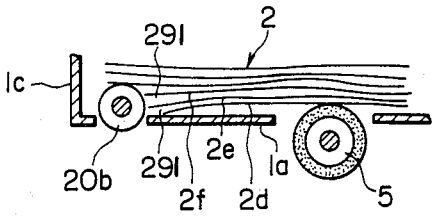

When the sheet of paper 2*c* is sent to the engaging portion, the sheets of paper 2*d*, 2*e* and 2*f* on the sheet 2*c* are dragged by the sheet of paper 2*c* as shown in FIG. 12*d* and the ends, opposite to the ejection port, of the sheets of paper are disengaged from the free roller 20*b* and drops downward.

Thus, the sheets of paper 2*d*, 2*e*, 2*f* have gaps 291 formed at the end portions opposite to the ejection port, and made free of the the weight of the sheets on the each sheet 2*d*, 2*e*, 2*f*. The sheets of paper 2*d*, 2*e* and 2*f* can be reliably sent out the engaging portion of the separation means.

As above mentioned, the operations are repeated successively, the sheets of paper 2 are surely separated and conveyed one by one from the lowermost.

In the respective embodiments as mentioned above, if a slot as shown by reference numeral 101 in FIG. 2, is formed in the bottom guide plate 1*a* in the vicinity of the support means over all a paper sheet width, the sheets of paper 2 can be dropped at their ends opposite to the feed-out side still lower than the surface of the bottom guide plate 1*a* when those ends are disengaged from the support means. This contributes to further enhance the effect of letting the sheets of paper to be disengaged at their ends opposite to the feed-out side from the support means.

Furthermore, although the roller type separation device was adopted as separation means in the foregoing embodiments, it is also possible to employ other friction type separation device such as one using a belt, for example. Additionally, it is a matter of course that the present invention is not limited to the embodiments as mentioned above and shown in the drawings, and can be practiced in various modified forms without departing the scope of the present invention.

What is claimed is:

1. A separating and feeding apparatus for sheets comprising:

accommodating means for accommodating stacked sheets, said accommodation means including guide surfaces allowing the sheets to be stacked by their own weight and an ejection port in a lower portion of a part of said guide surfaces, through which port the sheets are to be fed out sequentially, said ejection port having an opening dimensioned so as to allow a plurality of stacked sheets to enter at one time;

separation means provided out of said accommodation means near to said ejection port for separating the sheets of paper reaching said separation means and individually feeding the sheets sequentially from a bottom portion of said accommodation means;

pick up means disposed in the lower portion of said accommodation means for bearing at the upper surface thereof the weight of the accommodated sheets and sequentially picking and sending the sheet contacting therewith by friction force imparted to the sheets toward said ejection port; and support means, provided independently of said pick up means so that said pick up means is disposed between said ejection port and said support means and so as to provide a sufficient space to allow ends of plural sheets to be downwardly movable, for supporting the stacked sheets in the vicinity of their ends opposite to said ejection port, and allowing ends of plural sheets including the lowermost sheet to be free from the weight of the remaining sheets thereabove, said support means having a support port gradually shifted downwards according to the movement of the supported sheet toward said ejection port.

2. A separating and feeding apparatus for sheets according to claim 1, wherein, when the sheets accommodated in said accommodation means have a length of $L_P$ in the direction of feeding, the distance between a position slightly offset toward the side opposite to said ejection port from the acting portion of said separation means and the end of said support means on the ejection port side is equal to $L_F$, and the distance between the guide surface of said accommodation means on the ejection port side and the end of said support means on the ejection port side is equal to $L_H$, said support means is disposed in a position meeting the relationships of $L_F > L_P$ and $L_H < L_P$.

3. A separating and feeding apparatus for sheets according to claim 2, wherein said support means comprises a roller of a circular section extending at right angles to the direction of feeding of the sheets and supported to be freely rotatable.

4. A separating and feeding apparatus for sheets according to claim 2, wherein said support means includes means for imparting vibration to the stacked sheets on the side opposite to said ejection port.

5. A separating and feeding apparatus for sheets according to claim 2, wherein said support means comprises a driving roller having a shaft extending at right angles to the direction of feeding of the sheets and rotated by a driving device, and imparts a force allowing the sheets in contact with the roller to be forwarded to said ejection port so that the ends of the sheets opposite to said ejection port are freed from the weight of the sheets thereon.

6. A separating and feeding apparatus for sheets according to claim 5, wherein said roller has a surface giving the distance between said surface and the center of rotation of said roller varied in accordance with changes in the angular position of said roller, and rotation of said roller imparts both a conveying force and a vertical force to the sheets at their ends opposite to the feed-out side, so that the stacked sheets are vibrated at the ends opposite to the ejection port.

7. A separating and feeding apparatus for sheets according to claim 6, wherein said roller has an elliptical cross-section.

8. A separating and feeding apparatus for sheets of paper according to claim 6, wherein said roller is an eccentric roller.

9. A separating and feeding apparatus for sheets comprising:

an accommodation box for accommodating stacked sheets, said accommodation box comprising a substantially horizontal bottom guide plate and side guide plates upwardly extending from the side portions thereof in the vertical direction, said side guide plates having in the lower portion an ejection port extending along one side of said bottom guide plate, said ejection port having an opening dimensioned so as to allow plural ones of the stacked sheets to pass therethrough at a time;

separation means provided opposite to said ejection port for separating and feeding the sheets reaching said separation means one by one sequentially from the bottom of said accommodation box, said separation means including a feed roller, partially provided with a high coefficient of friction member on a periphery thereof and rotated in such a direction that the sheets are set out, and a friction roller of a high coefficient of friction rotated in an opposite direction off the rotating direction of said feed roller;

a pick up roller protruding into the interior of said accommodation box through an elongated hole formed in said bottom guide plate of said accommodation box perpendicular to the direction of the sheet feeding, said pick up roller being intermittently rotated by a driving device to send out plural sheets including the lowermost sheet of paper toward said ejection port by friction between the surface of said pick up roller and the lowermost sheet of paper and sheets thereon; and support means provided independently of said pick up roller so that said pick up roller is disposed between said ejection port and said support means, for supporting the sheets in a vicinity of their ends opposite to said ejection port, and for imparting a conveying force to the sheet in contact therewith so that the sheet ends opposite to said ejection port are disposed between said support means and said pick up roller at a time thereby being free from a weight of the remaining stacked sheets supported by said support means.

10. A separating and feeding apparatus for sheets according to claim 9, wherein said bottom guide plate of said accommodation box is rectangular, said side guide plates vertically extend upward from the respective sides of said bottom guide plate, and said ejection port is defined by the lower portion of one of said side guide plates and said bottom guide plate.

11. A separating and feeding apparatus for sheets according to claim 10, wherein, assuming that the sheets have a length of $L_P$ in the direction of feeding, the distance between a position slightly offset toward the side opposite to the ejection port from the acting portion of said separation means and the end of said support means on the ejection port side is equal to $L_F$, and the distance between the side guide plate of said accommodation means on the ejection port side and the end of said support means on the ejection port side is equal to $L_H$, said support means is disposed in a position meeting the relationships of $L_F > L_P$ and $L_H < L_P$.

12. A separating and feeding apparatus for sheets according to claim 11, wherein a slot extending at right angles to the direction of feeding of sheets is formed in said bottom guide plate of said accommodation box in the vicinity of said support means, and said support means is produced into the interior of said accommodation box through said slot.

13. A separating and feeding apparatus for sheets according to claim 12, wherein said support means is of a rotatable member coupled to a rotating device.

14. A separating and feeding apparatus for sheets according to claim 13, wherein said rotatable member is a roller with a circular section.

15. A separating and feeding apparatus for sheets according to claim 14, wherein said rotatable member is formed of a roller with en elliptical cross-section to vibrate to vertically move the stack at the end opposite to the ejection port.

16. A separating and feeding apparatus for sheets according to claim 14, wherein said rotatable member is formed of an eccentric roller to impart vertical vibration to the stacked sheets at the end opposite to the ejection port.

17. A separating and feeding apparatus for sheets according to claim 14, wherein said rotatable member is provided on the surface thereof with a plurality of projections extending perpendicular to the direction of feeding to impart vertical vibration to the stacked sheets at the end opposite to the ejection port.

18. A separating and feeding apparatus for sheets of paper according to claim 12, wherein said support means comprises a support member pivotably supported at one end thereof for supporting the sheets at their ends opposite to the ejection side, and means coupled to said support member at a point remote from the pivotal support point thereof and imparting a swing motion to said support member whereby the stacked sheets in the vicinity of their ends are vibrated.

19. A separating and feeding apparatus for sheets of paper comprising:

an accommodation box for accommodating stacked sheets of paper, said accommodation box comprising a bottom guide plate having four sides and disposed substantially horizontally, and side guide plates extending upwardly from said sides of said bottom guide plate, respectively;

an ejection port for the stacked sheets of paper formed between one of said four sides of said bottom guide plate and a lower portion of one of said guide plates, and having an opening dimensioned so as to allow plural sheets of paper to pass therethrough at a time;

a feed roller provided outside said accommodation box so as to face said ejection port, having a periphery partially provided with a member of a higher coefficient of friction than the other portion and driven by a driving device in a direction so that the sheets of paper are removed from the accommodation box;

a friction roller provided adjacent to said feed roller for providing a separation means for separating sheets and individually feeding these sheets in cooperation with said feed roller, said friction roller provided with a material of a high coefficient of friction at least on a periphery thereof and driven in a direction opposite to a rotating direction of said feed roller;

a support roller provided in a vicinity of ends of the stacked sheets opposite to said ejection port so as to project into an interior of said accommodation box from said bottom guide plate for supporting the ends of the stacked sheets; and a pick up roller provided between said ejection port and said support roller, contacting the lowermost sheet, and intermittently driven by a driving device so that plural ones of the stacked sheets are moved toward said separation means through said ejection port by frictional force, said support roller allowing the ends of the plural sheets moved toward said separation means to be freed from the weight of the remaining stacked sheets.

20. A separating and feeding apparatus for sheets of paper according to claim 19, wherein said pick up roller is disposed at a position slightly toward said ejection port from a center of said bottom guide plate in the feeding direction.

21. A separating and feeding apparatus for sheets of paper according to claim 20, wherein the upper portion of said support roller is in a slightly higher level than the upper portion of said pick up roller.

22. A separating and feeding apparatus for sheets of paper according to claim 20, wherein said support roller has a circular section and is freely rotatable about the axis of said support roller.

23. A separating and feeding apparatus for sheets of paper according to claim 22, wherein said support roller is connected to a driving apparatus so as to be forcedly driven.

24. A separating and feeding apparatus for sheets of paper according to claim 20, wherein said support roller has an elliptical cross-sectional shape and is connected to a driving device so as to be forcedly rotated a plural number of times during one rotational period of said pick up roller.

25. A separating and feeding apparatus for sheets comprising:

an accommodation box for accommodating stacked sheets, said accommodating box comprising a substantially horizontal bottom guide surface and side guide surfaces upwardly extending from peripheral portions thereof in the vertical direction, said side guide surfaces having in the lower portion of a part thereof an ejection port extending laterally across said bottom guide surface;

separation means provided opposite to said ejection port for separating and feeding the sheets accommodated in said accommodation box sequentially from the bottom;

a pick up roller provided to protrude into the interior of said accommodation box through an elongated hole formed in said bottom side surface of said accommodation box perpendicular to the direction feeding of the sheets, said pick up roller being intermittently rotated by a driving device to send out the lowermost sheet of paper toward said ejection port due to friction between the surface of said pick up roller and the lowermost sheet of paper;

support means for supporting the sheets in the vicinity of their ends opposite to said ejection port, and for imparting a conveying force to the sheet in contact therewith;

wherein said bottom guide surface of said accommodation box is rectangular, said side guide surfaces vertically extend upward from the respective sides of said bottom guide surface, and said ejection port is defined by the lower portion of one of said side guide surfaces and said bottom guide surface; and wherein, assuming that the sheets have a length of $L_P$ in the direction of feeding, the distance between a position slightly offset toward the side opposite to the ejection port from the action portion of said separation means and the end of said support means on the ejection port side is equal to $L_F$, and the distance between the side guide surface of said accommodation means on the ejection port side and the end of said support means on the ejection port side is equal to $L_H$, said support means is disposed in a position meeting the relationships of $L_F > L_P$ and $L_H < L_P$.

26. A separating and feeding apparatus for sheets according to claim 25, wherein a slot extending at right angles to the direction of feeding of the sheets is formed in said bottom guide surface of said accommodation box in a vicinity of said support means, and said support means is produced into the interior of said accommodation box through said slot.

27. A separating and feeding apparatus for sheets according to claim 26, wherein said support means comprises a rotatable member coupled to a rotating device.

28. A separating and feeding device according to claim 27, wherein said rotatable member is a roller with a circular cross section.

* * * * *